United States Patent [19]

Gernez

[11] 4,381,729

[45] May 3, 1983

[54] ELECTROSTATIC POWDER-DEPOSITING INSTALLATION

[75] Inventor: Alain Gernez, Orleans, France

[73] Assignee: Compagnie Europeenne pour l'Equipment Menager "CEPEM", Paris, France

[21] Appl. No.: 253,761

[22] PCT Filed: Jul. 22, 1980

[86] PCT No.: PCT/FR80/00124

§ 371 Date: Mar. 27, 1981

§ 102(e) Date: Mar. 24, 1981

[87] PCT Pub. No.: WO81/00362

PCT Pub. Date: Feb. 19, 1981

[30] Foreign Application Priority Data

Jul. 27, 1979 [FR] France ..... 79 19474

[51] Int. Cl.[3] ..... B05B 5/04

[52] U.S. Cl. ..... 118/622; 118/631; 118/634

[58] Field of Search ..... 118/622, 631, 634, 309, 118/312, 317; 427/28, 181; 98/115 SB

[56] References Cited

U.S. PATENT DOCUMENTS

| | | | |
|---|---|---|---|
| 3,279,421 | 10/1966 | Tilney et al. | 118/631 X |
| 3,537,426 | 11/1970 | Spiller | 118/629 |
| 3,905,785 | 9/1975 | Fabre | 118/634 X |
| 4,301,764 | 11/1981 | Campion et al. | 118/634 |

FOREIGN PATENT DOCUMENTS

| | | | |
|---|---|---|---|
| 26073 | of 1904 | United Kingdom | 118/317 |

*Primary Examiner*—Evan K. Lawrence

*Attorney, Agent, or Firm*—Sughrue, Mion, Zinn, Macpeak and Seas

[57] ABSTRACT

An electrostatic powder-depositing installation for depositing powder on hollow parts of large dimensions. It includes a powder-depositing cage (1) which is open at the top and a powder-depositing unit (41) placed beneath this opening (2) so that the hollow parts vertically fit over the powder-depositing unit as they pass through the opening of the powder-depositing cage. Application is to installations for coating parts and, in particular, metal parts.

13 Claims, 12 Drawing Figures

ELECTROSTATIC POWDER-DEPOSITING INSTALLATION

The present invention relates to depositing powder on parts by an electrostatic powder-depositing method in accordance with which a cloud of electrified enamel powder is projected inside a cage containing the part to be covered. The powder adheres to the part by the effect of electrostatic forces. A subsequent heat treatment applied to the part transforms the layer of powder into an enamel coating. During powder-deposition, only some of the particles of powder become fixed to the part which is to be coated; the remainder of the particles of powder fall below the part or try to escape outside the powder-depositing cage.

BACKGROUND OF THE INVENTION

The applicant's French Pat. No. 7 833 945 discloses a powder-depositing installation of integrated type which includes at least a cage, a powder supply system, a powder-recovery tank, and recycling units which include a powder-filtering system placed inside the cage which simultaneously forms a powder storage and dosing tank and a powder-recovery tank.

The invention aims to produce an installation of this type which can be used to deposit powder on the inside of hollow parts.

While the cage in accordance with the above-mentioned patent allows powder to be deposited principally on flat parts, this requiring only one narrow opening for the insertion of the parts on which powder is to be deposited, the installation in accordance with the present application includes an opening of large dimensions which allows the insertion of hollow parts which are necessarily broader than a flat part. The increase in the dimensions of the opening increases the possibility of powder escaping towards the outside.

The invention aims in particular to prevent the powder from leaving via this large opening.

SUMMARY OF THE INVENTION

The invention provides an electrostatic powder-depositing installation for depositing powder in hollow parts of large dimensions, characterized in that it includes a powder-depositing cage which is open at the top and a powder-depositing unit placed beneath this opening so that the hollow parts vertically fit over the powder-depositing unit as they pass through the opening of the powder-depositing cage and in that the powder-depositing unit is rotatably mounted such that all the inside surfaces of the hollow part can be powder-covered.

The characteristics and advantages of the invention become apparent from the following description of one embodiment of the invention given by way of example with reference to the accompanying drawings.

DESCRIPTION OF PREFERRED EMBODIMENTS

Figure 1:
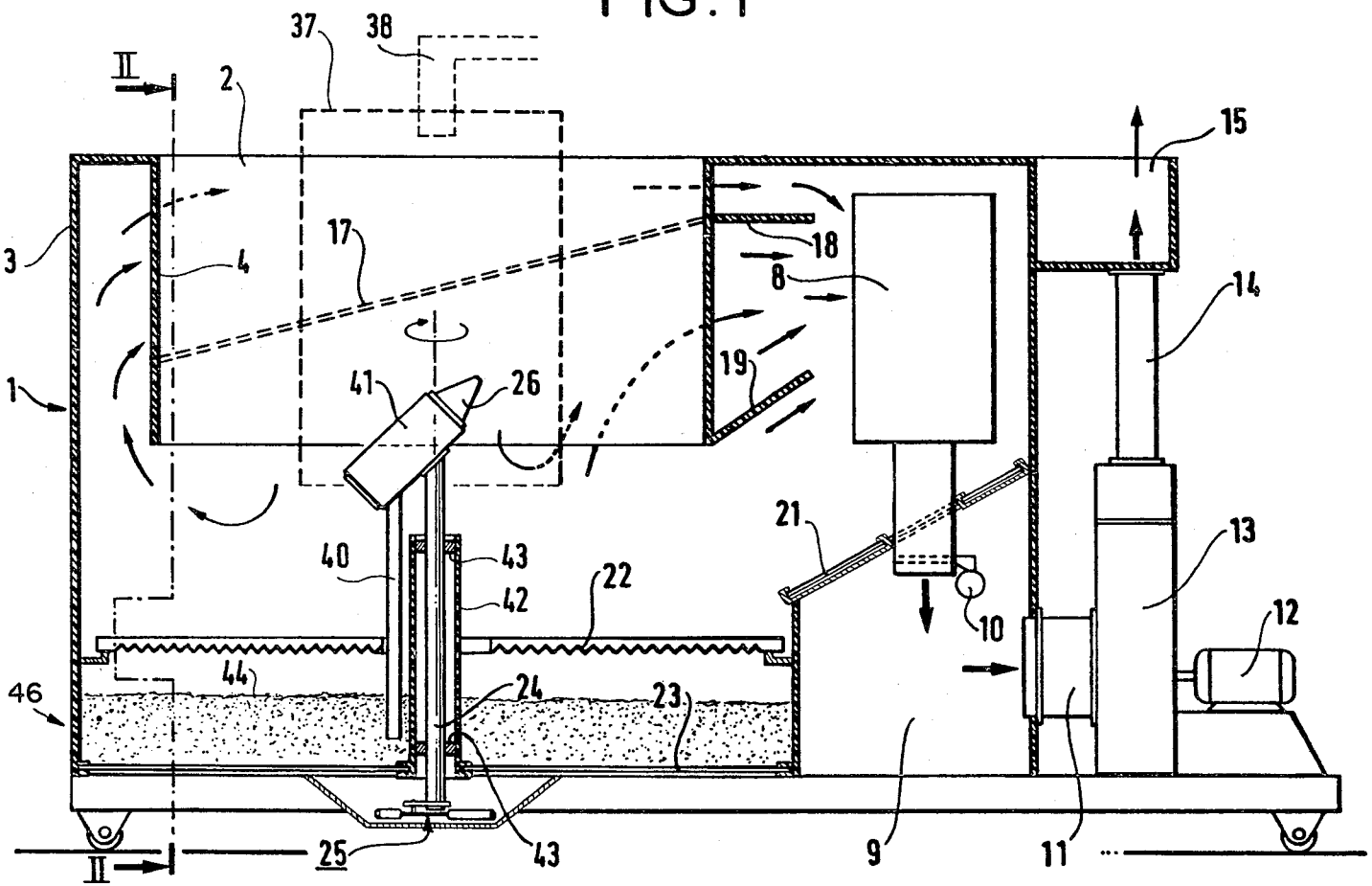
FIG. 1 is a schematic elevation, partially in section of a powder-depositing cage in accordance with the invention.
Figure 2:
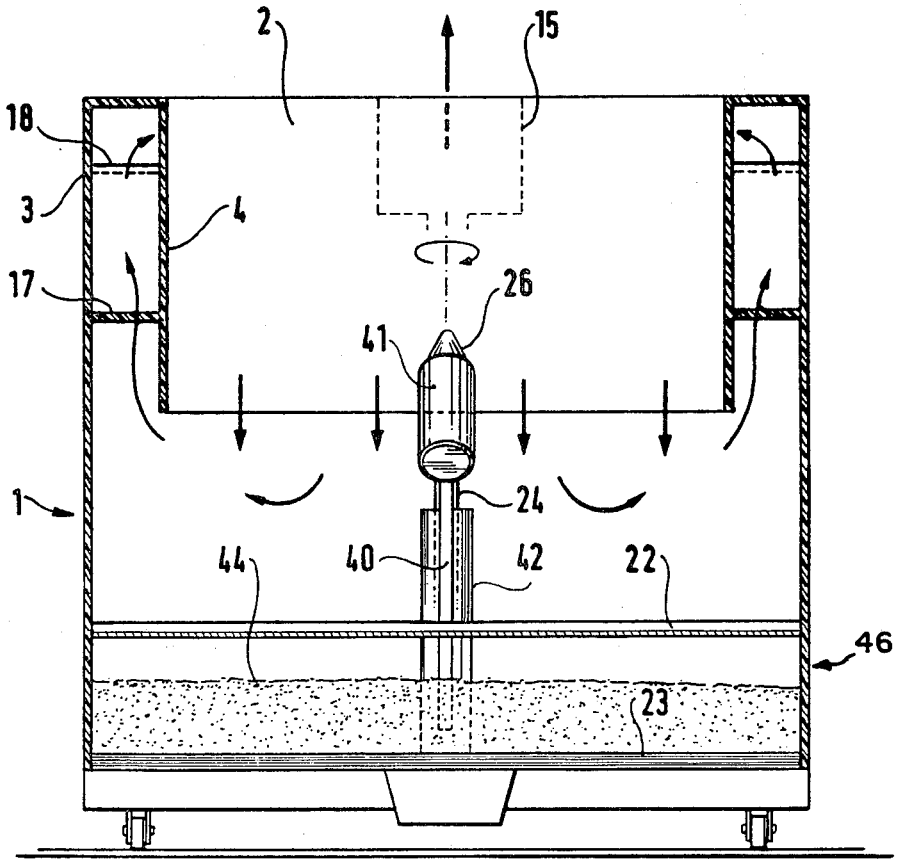
FIG. 2 is a cross-section along line II—II of FIG. 1.

In the embodiment illustrated in FIGS. 1 and 2, the installation includes a cage 1 provided with a wide, parallelepiped horizontal opening 2 in its upper end for inserting the parts to be treated. The cage has an outer wall 3 and an inner wall 4 which forms a parallelepiped powder-depositing chamber for the parts to be treated. Walls 3 and 4 form together an air recycling box or peripheral chamber.

The cage has e.g. two filtering elements 8, only one being shown, connected to an aspiration box 9 which contains an unclogging unit 10 to recondition the filtering elements.

Air laden with powder descends via the central portion of the powder-depositing chamber then rises up the sides between the walls 3 and 4 under the aspiration effect of the filtering elements 8. The aspiration box 9 is connected to a ventilator or blower 11 driven by a motor 12 which sets up a vacuum in the box 9 and returns the aspirated air into a box 15 which is open on the outside. Separation plates 17 disposed between the two partitions 3 and 4 serve to direct the air by means of deflectors 18, 19 towards the filtering elements 8.

The powder collected on the filtering elements 8 falls after reconditioning on an inclined fluidization element 21 then drops onto a sifter 22 for separating metal particles. The powder is conveyed to the bottom of the cage 1 in which powder is stored in a powder recovery tank 46. Said powder is fluidized by fluidizing elements 23 disposed on the bottom of the cage 1 and is drawn directly by a dipper 40 of a powder-depositing gun 41 installed on a nozzle holder 24 which is rotated by a unit 25 described hereinafter. The upper portion of the gun 41 ends in a projection nozzle 26.

When powder is aspirated into the cage by the filtering elements it is deflected downwards and prevented from escaping from the cabin via the horizontal opening 2 through which hollow parts to be treated are inserted.

The gun 41 may be of the type described in the Applicant's French Pat. No. 79 01 970.

The nozzle holder 24 rotates inside a sleeve 42 fixed to the floor of the cage e.g. by welding or soldering. Two seals 43 or sealed bearings seal the nozzle holder in the sleeve. The upper hole of the sleeve is preferably above the level of the powder.

Figure 5:
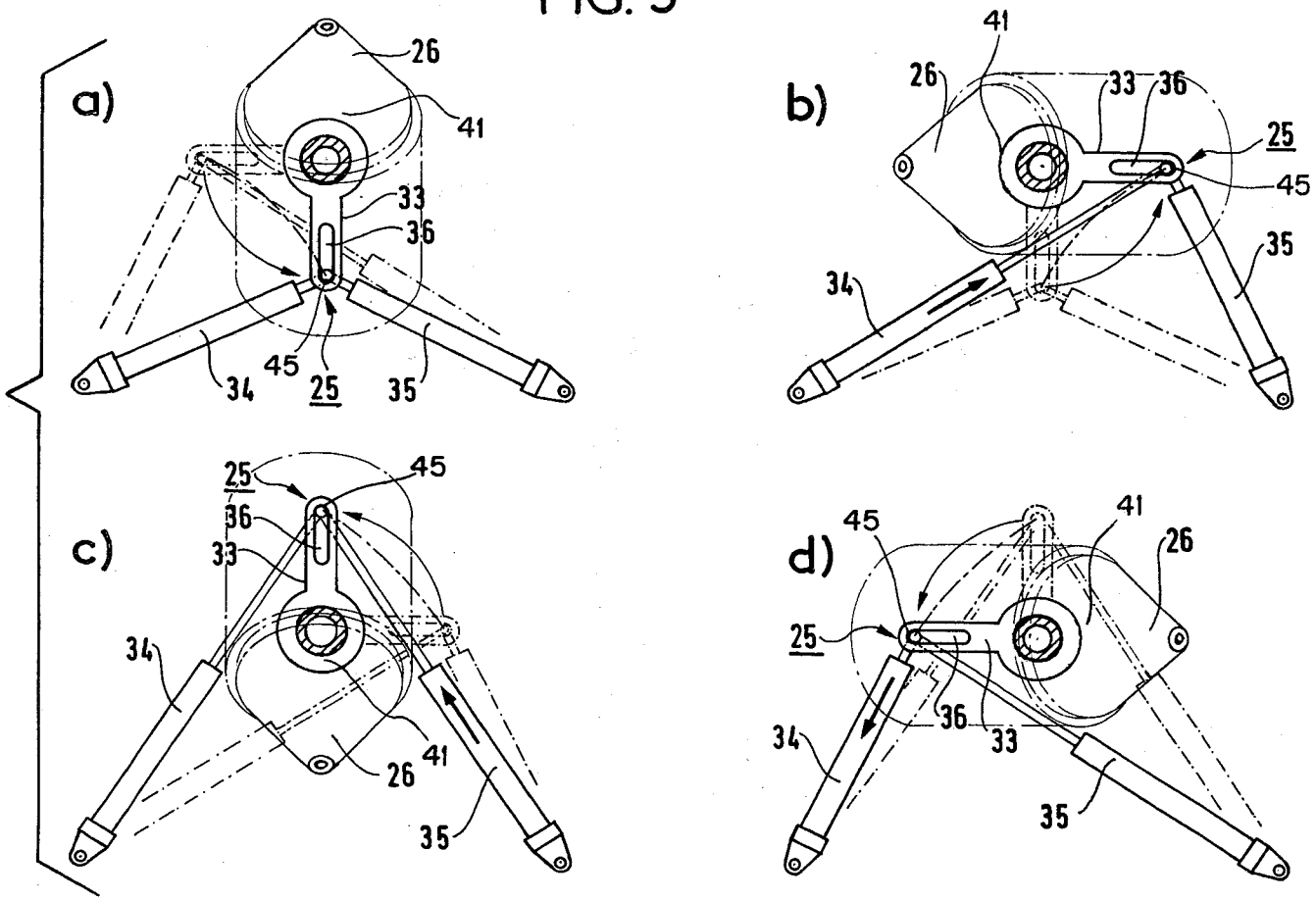
FIGS. 5(*a*) through 5(*d*) are sectional views about line V—V of FIG. 3 showing the nozzle-holder rotation control unit in four positions with the powder-depositing gun in phantom lines.

A unit 25 illustrated in FIGS. 5(*a*), 5(*b*), 5(*c*) and 5(*d*) rotates the nozzle holder 24.

The nozzle holder 24 is fixed on a connecting rod 33 which is rotated by two jacks 34 and 35 through an axle 45. Each of the jacks has one of its ends fixed to a frame (not shown) and the nozzle holder can assume any one of four positions, FIGS. 5(*a*), 5(*b*), 5(*c*), 5(*d*), by rotating through a quarter of a turn each time as shown in FIGS. 5(*a*) to 5(*d*) according to whether the jacks are extended or retracted. In position 5*a*, both jacks 34,35 are retracted, in position 5*b*, jack 34 is pressurized; in position 5*c*, both jacks are pressurized; in position 5*d*, jack 35 is kept pressurized and a vacuum is set up in jack 34. A slot 36 facilitates the rotating movement of the parts.

The nozzle holder can be returned to its initial position by performing the movements in the reverse order.

Figure 6:
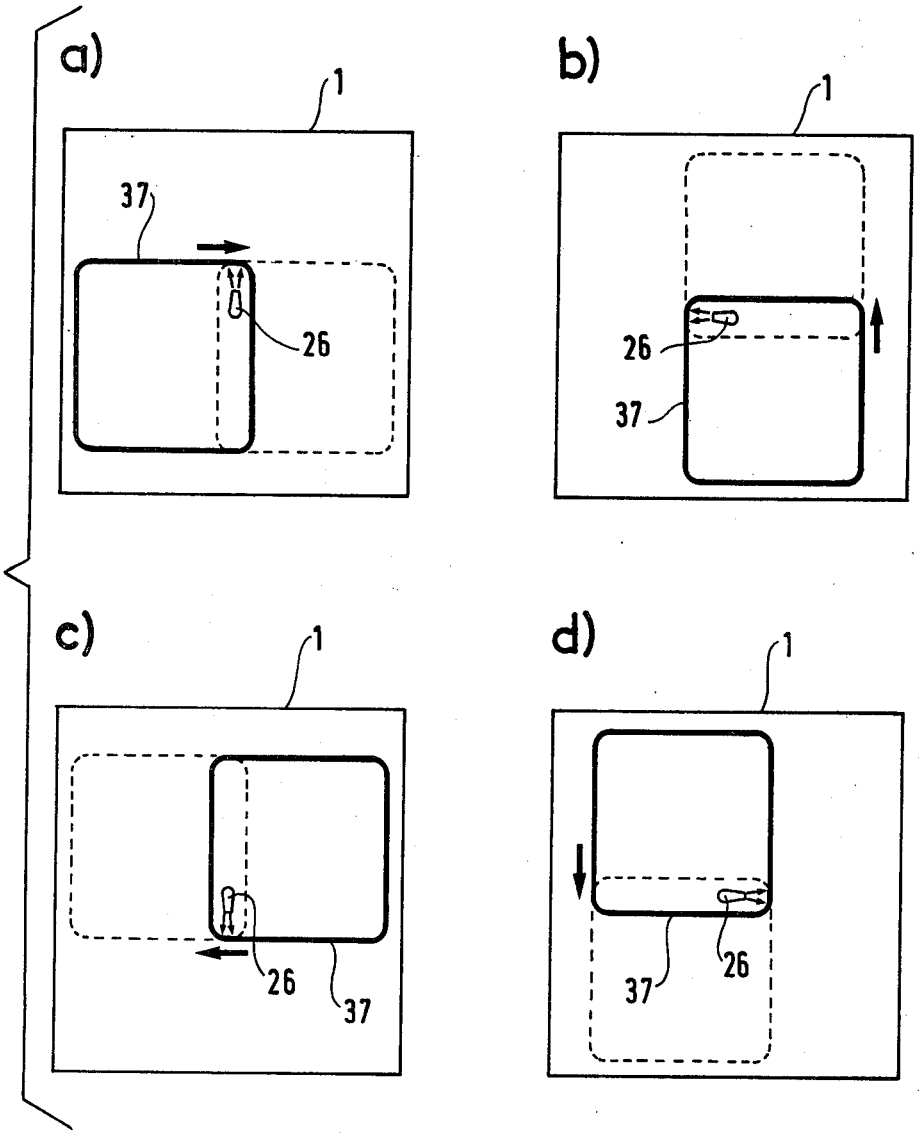
FIGS. 6(*a*) through 6(*d*) are plan views illustrating schematically four positions of a part on which powder is to be deposited, said powder being inside the powder-depositing cage, with the powder-depositing nozzle in each of the four positions.

The invention may be embodied in the manner shown schematically in FIGS. 6(*a*), 6(*b*), 6(*c*), 6(*d*), in which nozzle 26 is in the same positions as in FIGS. 5(*a*), 5(*b*), 5(*c*), 5(*d*). A hollow part 37 to be treated is placed inside the cage 1 by a manipulator 38 (FIG. 1). Between the different positions, the part moves by translation without rotation and nozzle 26 rotates as illustrated in FIGS. 5*a* to 5*d* so as to bring all the inside surfaces of the part in front of the projection nozzle. Powder is spread up the whole height of the part by moving the part vertically.

Figure 3:
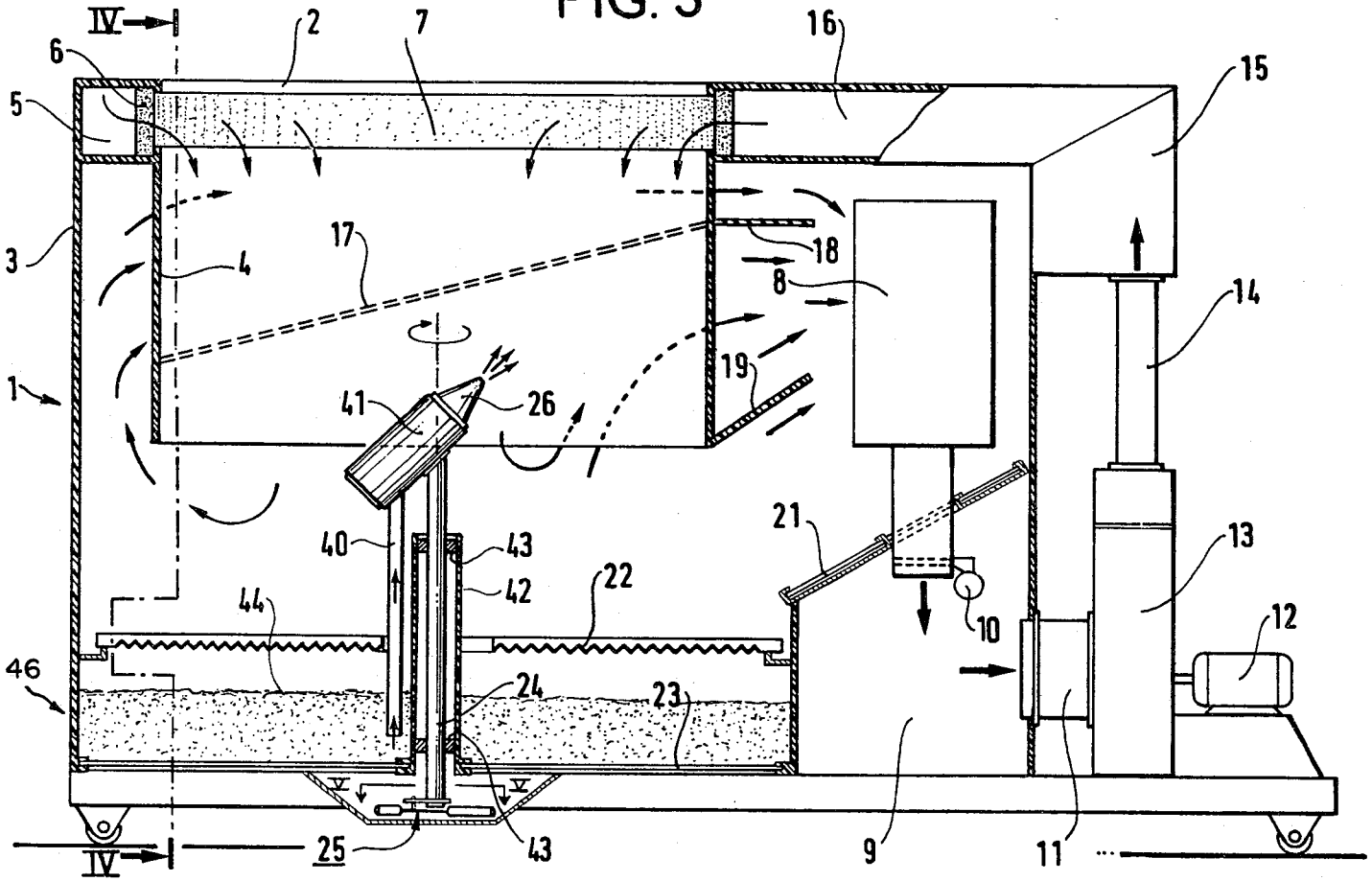
FIG. 3 is a schematic elevation, partially in section of a variant of a cage.
Figure 4:
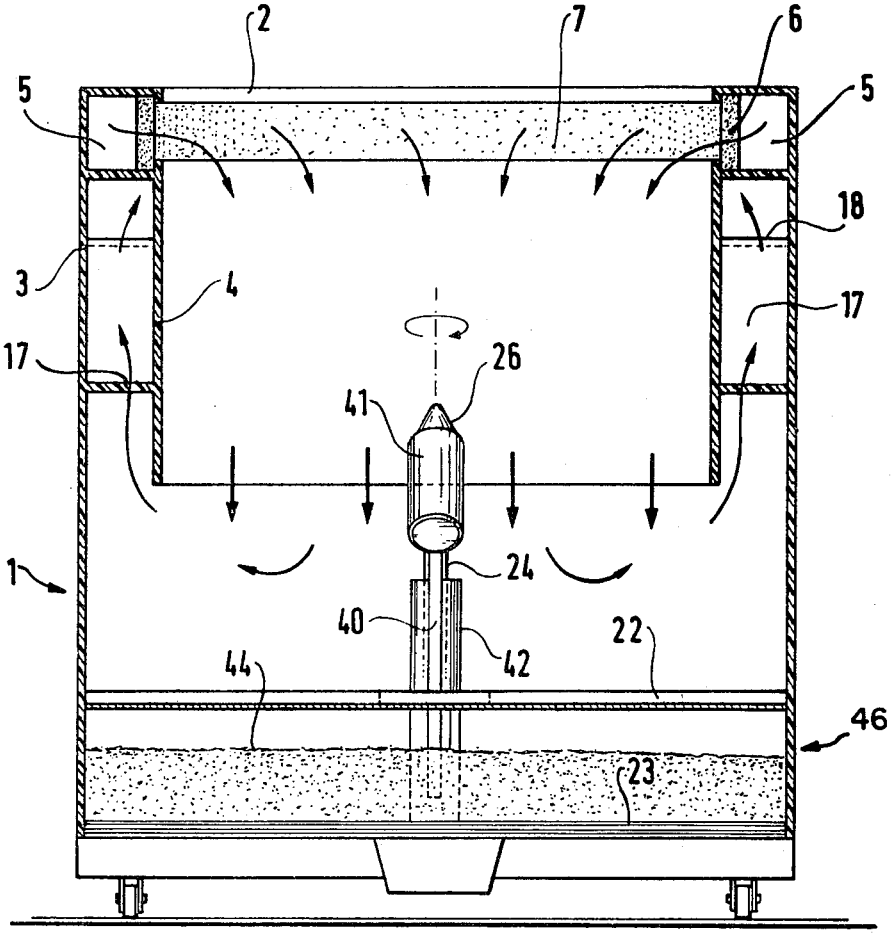
FIG. 4 is a cross-section along line IV—IV of FIG. 3.

In the variant illustrated in FIGS. 3 and 4, wherein like numerals identify like elements, the installation includes a cage 1 provided with a wide horizontal opening 2 at its upper end for inserting the hollow parts which are to be treated. The cage has an outer wall 3 and an inner wall 4 which forms a powder-depositing chamber for the parts to be treated. Walls 3 and 4 form together an air recycling box. The upper end of cage 1 has a blowing box 5 disposed around the opening 2. The blowing box is closed by a high-efficiency filter 6, here called an ultrafilter, which distributes the flux all around the periphery of the opening 2 so as to constitute an inlet air-lock 7.

Air laden with powder descends via the central portion of the powder-depositing chamber then rises up the sides between the walls 3 and 4 under the aspiration effect of the filtering elements 8. The aspiration box 9 is connected to a ventilator or blower 11 driven by a motor 12 which sets up a vacuum in the box 9 and returns the aspirated air into an air recycling circuit 13,14,15,16 which communicates with the blowing box 5. Separation plates 17 disposed between the two partitions 3 and 4 serve to direct the air by means of deflectors 18, 19 towards the filtering elements 8.

The powder collected on the filtering elements falls after reconditioning on an inclined fluidization element 21 then drops onto a sifter 22 for separating out metal particles. The powder is conveyed to the bottom of the cage 1 in which powder is stored. Said powder is fluidized by fluidizing elements 23 disposed on the bottom of the cage 1 and is drawn directly by the dipper 40 of the gun 41 installed on a nozzle holder 24 which is rotated by the unit 25.

When the powder is aspirated into the cage and recycled air is blown around the opening for inserting the parts to be treated, the powder is prevented from escaping from the cage via this opening.

The nozzle holder is assembled and rotated as in the case of FIGS. 1,2 and 5.

The invention can advantageously be applied to depositing powder on hollow parts such as muffles of cooking ovens. Only one powder depositing gun is illustrated, but the cage may contain several stationary or moving guns; in particular one gun can be placed at each angle of the powder depositing cage.

I claim:

1. In an electrostatic powder-depositing installation for depositing powder on the interior of hollow parts of large dimensions, said installation comprising: a powder-depositing cage, a powder-depositing unit placed within said cage using air for depositing powder on said hollow parts, a vacuum pressure filtering system for removing non-deposited powder from the air used in the coating operation, a system for supplying powder to said powder-depositing unit, and a non-deposited powder recovery tank for recovery of powder, the improvement wherein said powder-depositing cage comprises vertical exterior walls and a horizontal top wall, vertical interior walls extending downwardly from said top wall towards the bottom of the cage but terminating short of said cage bottom and being spaced from said vertical exterior walls to define a relatively large opening within the top wall of said cage through which non-deposited powder tends to escape, and forming a powder-depositing chamber such that downwardly open hollow parts may be vertically dropped to fit over the powder-depositing unit positioned within said chamber by passage of the hollow parts through the opening within the top wall of the powder-depositing cage, and wherein said top wall and said interior and exterior walls define a peripheral chamber for collecting of air bearing non-deposited powder, said peripheral chamber leading to said filtering system such that air loaded with said non-deposited powder is vacuum drawn into the peripheral chamber and thereby prevented from escaping through the cage top wall opening and is subsequently filtered in said filtering system to collect the non-deposited powder, said non-deposited powder being recovered by said recovery tank connected to said filtering system, and recycled to the powder-depositing unit connected to said recovery tank for further employment in the projection of powder onto said parts.

2. An installation according to claim 1, wherein said powder recovery tank is placed beneath the top wall opening of said cage, and wherein said vacuum pressure filtering system comprises an aspiration unit to deflected the non-deposited powder emanating from the powder-depositing unit downward and means for causing the falling powder to pass into the powder recovery tank.

3. An installation according to claim 2, wherein the opening of the cage is permanently open.

4. An installation according to claim 1, wherein said powder-depositing unit includes a stationary sleeve (42), a powder-depositing nozzle (26) installed on a nozzle-holder (24) rotatably assembled inside said sleeve, and said unit having at least two jacks for driving said nozzle-holder in rotation about said sleeve axis.

5. An installation according to claim 4, further comprising means for alternatively operating said jacks to apply a sequential movement to said nozzle-holder of four quarter turns.

6. An installation according to claim 4, wherein the unit for driving said nozzle-holder is placed beneath said powder-depositing unit and in a place where powder cannot reach it.

7. An installation according to claim 6, further comprising means for sealably assembling said nozzle-holder in the sleeve and means for sealing said sleeve to the bottom of said cage.

8. An installation according to claim 5, wherein said nozzle-holder is rotated through an axle to which are fixed the free ends of said two jacks and a connecting rod which connects the nozzle-holder to said axle.

9. An installation according to claim 8, wherein said jacks are fixed to a frame on which they can move to retracted and extended positions to operate said nozzle-holder.

10. An installation according to claim 9, wherein said jacks form an angle with said connecting rod such that when said free ends of said jacks are selectively projected and retracted, said powder-depositing nozzle is moved to positions constituting the vertices of a square.

11. An installation according to claim 1, wherein said filtering system includes a filtering unit positioned interiorly of said cage within said peripheral chamber for collecting non-deposited powder and being directly open to said peripheral chamber, an aspiration box underlying said filtering unit and being connected thereto, a blower having a suction opening connected to said aspiration box, a blowing box disposed about the periphery of the enclosure formed by the external wall and the internal wall isolated from and being above the peripheral chamber and communicating with said relatively large opening within the top wall and being connected to the discharge of said blower, so as to deflect downwardly with air, powder tending to escape through the opening within said top wall of said cage towards the inside of said cage to said peripheral chamber.

12. An installation according to claim 11, wherein said blowing box communicates with said opening via a filter (6) which distributes air around the periphery of said opening.

13. An installation according to claim 1 or claim 12, wherein said powder-depositing unit includes a dipper tube extending downwardly from a powder depositing gun of said powder-depositing unit rotating within said hollow part and said dipper tube opens into said powder-recovery tank below the level of powder accumulating therein for conducting accumulated powder to said gun.

* * * * *